US007541985B2

(12) United States Patent
Lin

(10) Patent No.: US 7,541,985 B2
(45) Date of Patent: Jun. 2, 2009

(54) MULTI-BROAD BAND ANTENNA AND ELECTRONIC DEVICE THEREOF

(75) Inventor: Hui Lin, Taoyuan (TW)

(73) Assignee: Quanta Computer Inc., Tao Yuan Shien (TW)

( * ) Notice: Subject to any disclaimer, the term of this patent is extended or adjusted under 35 U.S.C. 154(b) by 17 days.

(21) Appl. No.: 11/892,730

(22) Filed: Aug. 27, 2007

(65) Prior Publication Data

US 2008/0180343 A1 Jul. 31, 2008

(30) Foreign Application Priority Data

Jan. 30, 2007 (TW) ..... 96103427 A

(51) Int. Cl.
*H01Q 1/38* (2006.01)

(52) U.S. Cl. ..... 343/700 MS

(58) Field of Classification Search ..... 343/700 MS
See application file for complete search history.

(56) References Cited

U.S. PATENT DOCUMENTS

2008/0122698 A1* 5/2008 Ollikainen et al. .... 343/700 MS

* cited by examiner

*Primary Examiner*—Rexford N Barnie
*Assistant Examiner*—Thienvu V Tran
(74) *Attorney, Agent, or Firm*—Rabin & Berdo, PC.

(57) ABSTRACT

A multi-broad band antenna including a first radiating body, a second radiating body, a third radiating body, a grounding plate and many short-circuit elements is provided. The first radiating body excites a first resonant mode, such that the multi-broad band antenna has a high frequency wide bandwidth. The second radiating body excites a second resonant mode, such that the multi-broad band antenna has a middle frequency wide bandwidth. The third radiating body excites a third resonant mode, such that the multi-broad band antenna has a low frequency wide bandwidth. A number of short-circuit elements connect the first radiating body, the second radiating body and the third radiating body to the grounding plate respectively. The radiation patterns of the first resonant mode, the second resonant mode and the third resonant mode do not disturb each other.

25 Claims, 12 Drawing Sheets

200 The portable electronic device

WLAN

2400~2500MHz

4900~5875MHz

4900~5875MHz

4900~5875MHz

GPS

1570~1580MHz

GSM

824~894MHz

1850~1990MHz

MULTI-BROAD BAND ANTENNA AND ELECTRONIC DEVICE THEREOF

This application claims the benefit of Taiwan application Serial No. 96103427, filed Jan. 30, 2007, the subject matter of which is incorporated herein by reference.

BACKGROUND OF THE INVENTION

1. Field of the Invention

The invention relates in general to a multi-broad band antenna and a portable electronic device thereof, and more particularly to a multi-broad band antenna resonating many broad bands with a single conductive structure and a portable electronic device thereof.

2. Description of the Related Art

Normally, an antenna resolves the multi-path interference problem by an antenna diversity structure. When a radio frequency system adopts multi-band operation, most antennas achieve antenna diversity by many independent antennas or a composite antenna. As a result, the system becomes complicated and the operating reliability is reduced. Thus, conventional multi-band antenna excites many resonant modes according to the frequency-doubling effect of resonant structure to achieve multi-band operation.

However, the above design is subjected to the restriction that the central frequencies of the resonant modes form a multiple relationship and that all bandwidths of the resonanat modes are narrow bands such that the bandwidth of the antenna is difficult to expand. For example, the 2.4 GHz and 5 GHz dual-band antenna used in a wireless local area network (WLAN) normally receives and transmits a 5 GHz electromagnetic wave signal by adjusting the structural parameters of 2.4 GHz double-band resonant mode (that is, 4.8 GHz). Thus, the efficiency in the transmission of high frequency electromagnetic wave is normally poor, largely affecting signal quality. Furthermore, as the multiple relationships among the resonant modes, the frequency-doubling effect is not applicable to the frequency ranges of 2.4~2.4835 GHz, 4.9~5.35 GHz, 5.47~5.725 GHz and 5.725~5.825 GHz required for the operation of WLAN 802.11a/b/g. This is because the multiple relationship does not exist in the bands of 5 GHz frequency range, and the overall bandwidth is too wide (approximates 1 GHz).

Current trends of notebook computer are focused on diversified wireless communication functions, particularly the ultra mobile PC (UMPC) further incorporates global positioning system (GPS). Thus, to incorporate the global standard for mobile system (GSM) within 824~894 MHz and 1850~1990 MHz, the global positioning system within 1.575 GHz and the WLAN system within 2.4~2.5 GHz and 4.9~5.875 GHz in a single structure is a great challenge to the volumetric efficiency of an antenna and the electrical characteristics thereof.

SUMMARY OF THE INVENTION

The invention is directed to a multi-broad band antenna and a portable electronic device thereof. The multi-broad band antenna incorporates many systems such as GPS, GSM and WLAN by an integrally formed conductive structure without employing any medium. As a result, the multi-broad band antenna has a minimized volume, excellent high frequency characteristics and high reliability.

According to a first aspect of the present invention, a multi-broad band antenna including a first radiating body, a second radiating body, a third radiating body, a grounding plate and a number of short-circuit elements is provided. The first radiating body excites a first resonant mode, such that the multi-broad band antenna has a high frequency wide bandwidth. The second radiating body excites a second resonant mode, such that the multi-broad band antenna has a middle frequency wide bandwidth. The third radiating body excites a third resonant mode, such that the multi-broad band antenna has a low frequency wide bandwidth. A number of short-circuit elements connect the first radiating body, the second radiating body and the third radiating body to the grounding plate respectively. The radiation patterns of the first resonant mode, the second resonant mode and the third resonant mode do not disturb each other.

According to a second aspect of the present invention, a portable electronic device including a shielding metal and a multi-broad band antenna is provided. The shielding metal is used for reducing electromagnetic interference. The multi-broad band antenna includes a first radiating body, a second radiating body, a third radiating body, a grounding plate and a number of short-circuit elements. The first radiating body excites a first resonant mode, such that the multi-broad band antenna has a high frequency wide bandwidth. The second radiating body excites a second resonant mode, such that the multi-broad band antenna has a middle frequency wide bandwidth. The third radiating body excites a third resonant mode, such that the multi-broad band antenna has a low frequency wide bandwidth. The short-circuit elements connect the first radiating body, the second radiating body and the third radiating body to the grounding plate respectively. The radiation patterns of the first resonant mode, the second resonant mode and the third resonant mode do not disturb each other.

The invention will become apparent from the following detailed description of the preferred but non-limiting embodiments. The following description is made with reference to the accompanying drawings.

DETAILED DESCRIPTION OF THE INVENTION

Figure 1A:
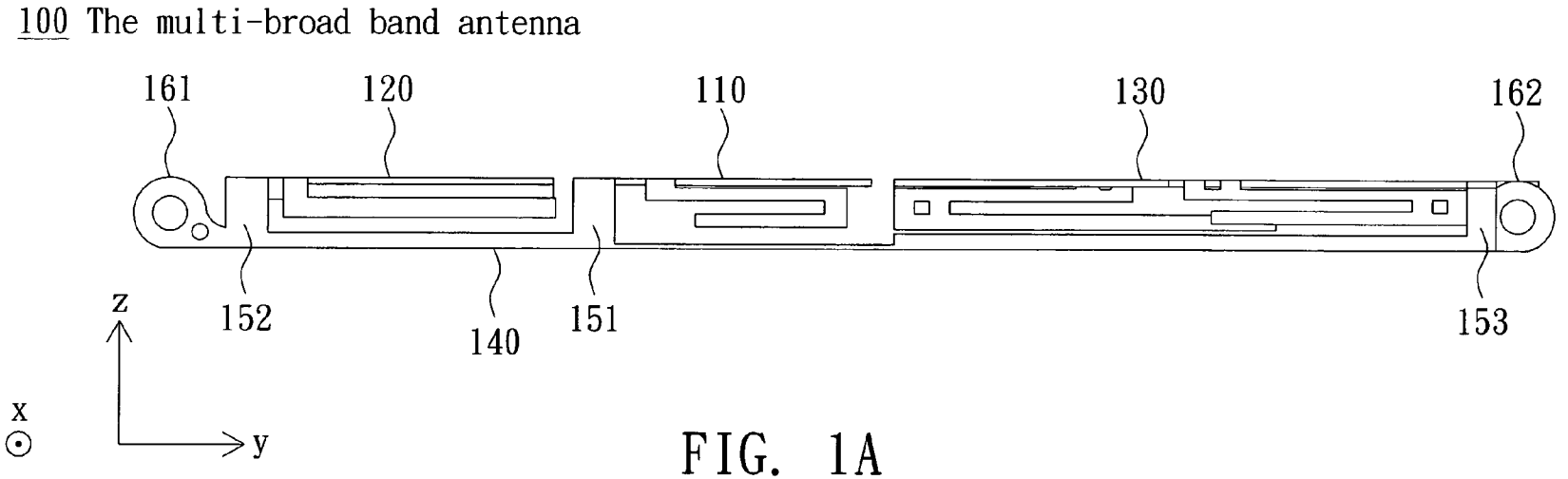
FIG. 1A is a front view of a multi-broad band antenna according to a preferred embodiment of the invention.
Figure 1B:
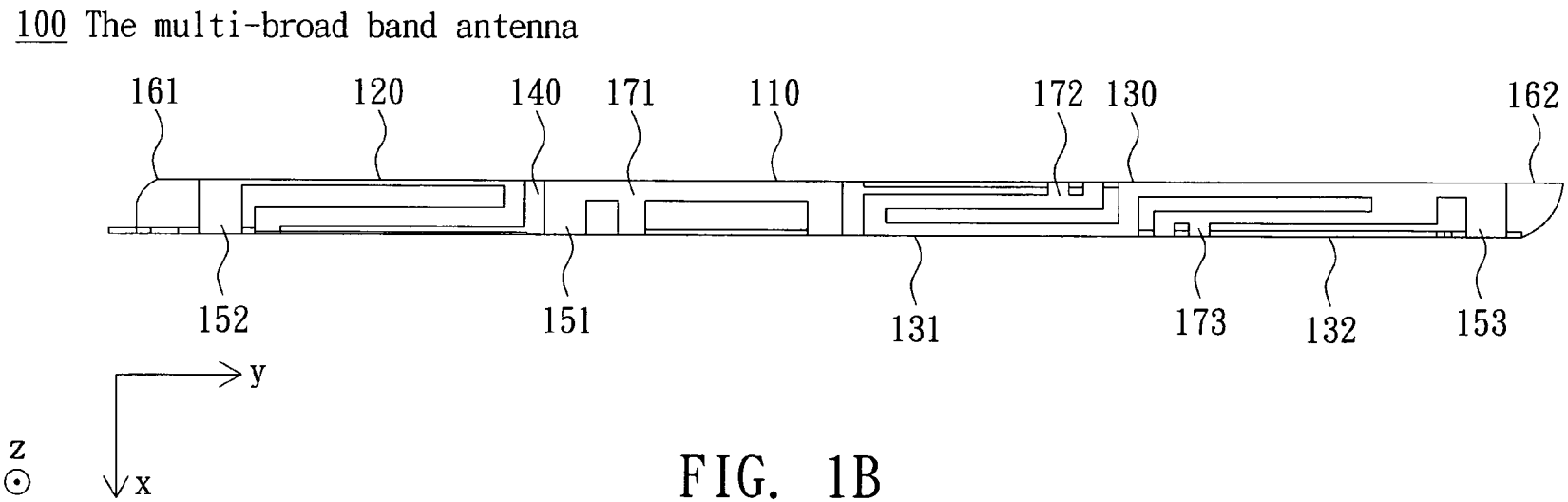
FIG. 1B is a top view of a multi-broad band antenna according to a preferred embodiment of the invention.

Referring to FIG. 1A and FIG. 1B. FIG. 1A is a front view of a multi-broad band antenna according to a preferred embodiment of the invention. FIG. 1B is a top view of a multi-broad band antenna according to a preferred embodiment of the invention. The multi-broad band antenna 100 includes a first radiating body 110, a second radiating body 120, a third radiating body 130, a grounding plate 140 and a number of short-circuit elements 151~153. The first radiating body 110, the second radiating body 120, the third radiating body 130, the grounding plate 140 and a number of short-circuit elements 151~153 are integrally formed in one piece.

The multi-broad band antenna 100 incorporates the global standard for mobile system (GSM), the global positioning system (GPS) and the wireless local area network (WLAN) and is operated under many different bandwidths such as 824~894 MHz, 1850~1990 MHz, 1.575 GHz, 2.4~2.5 GHz and 4.9~5.875 GHz. The frequency range of 2.4~2.5 GHz and 4.9~5.875 GHz is defined as a high frequency wide bandwidth, the frequency range of 1.575 GHz is defined as a middle frequency wide bandwidth, and the frequency range of 824~894 MHz and 1850~1990 MHz is defined as a low frequency wide bandwidth such that the requirements of multi-broad band design are satisfied.

In terms of signal transmission, the first radiating body 110, the second radiating body 120 and the third radiating body 130 respectively have a feed-in point (not illustrated in the diagram) for feeding the multi-broad band antenna 100 with signals. The first radiating body 110 is used for exciting a first resonant mode, such that the multi-broad band antenna 100 has the high frequency wide bandwidth which frequency range is 2.4~2.5 GHz and 4.9~5.875 GHz. The multi-broad band antenna 100 has a wide range of high frequency wide bandwidth. Therefore, in practical application, a T-shaped symmetric structure 171 is disposed on the first radiating body 110, such that the first radiating body 110 has two current paths to meet the broad band requirement of the high frequency wide bandwidth. In other words, under the first resonant mode of the first radiating body 110, the T-shaped symmetric structure 171 enables the multi-broad band antenna 100 to meet the broad band design requirement of the high frequency wide bandwidth, that is, the multi-broad band antenna 100 is able to receive a wireless local area network (WLAN) signal.

The second radiating body 120 is used for exciting a second resonant mode. The second resonant mode enables the multi-broad band antenna 100 to meet the design requirement of the middle frequency wide bandwidth of which the central frequency is 1.575 GHz, such that the multi-broad band antenna 100 is able to receive a global positioning system (GPS) signal. The third radiating body 130 is used for exciting a third resonant mode, such that the multi-broad band antenna 100 has a low frequency wide bandwidth which frequency range is 824~894 MHz and 1850~1990 MHz. As the low frequency wide bandwidth needs to have two different low frequency bands, the third radiating body 130 includes two sub-radiating bodies 131~132, such that the third radiating body 130 is able to meet the requirement that low frequency wide bandwidths 824~894 MHz and 1850~1990 MHz have different low frequency bands. Besides, the two sub-radiating bodies 131~132 respective have a T-shaped symmetric structure 172 and a T-shaped symmetric structure 173 for expanding the bandwidth, such that the third resonant mode of the third radiating body 130 enables the multi-broad band antenna 100 to meet the broad band design requirement of the low frequency wide bandwidth, that is, the multi-broad band antenna 100 is able to receive a global standard for mobile system (GSM) signal.

As indicated in FIG. 1A and FIG. 1B, the radiation pattern of the first resonant mode excited by the first radiating body 110 mainly diverges towards the x-direction, the radiation pattern of the second resonant mode excited by the second radiating body 120 mainly diverges towards the z-direction, and the radiation pattern of the third resonant mode excited by the third radiating body 130 mainly diverges towards the −x-direction. As the radiation patterns of the first resonant mode, the second resonant mode and the third resonant mode diverge towards different directions, the mutual interference is reduced to a minimum. The invention is not limited to the divergence towards the x-direction, the y-direction or the z-direction, and as long as the three radiation patterns do not disturb each other is within the scope of technology of the invention. Or, the dispositions of the first radiating body 110, the second radiating body 120 and the third radiating body 130 are adjusted according to the radiation patterns of the first resonant mode, the second resonant mode and the third resonant mode. For example, a part of the multi-broad band antenna 100 is without a radiating body, such that the radiation patterns of the first resonant mode, the second resonant mode and the third resonant mode have more space for radiating and that the efficiency of signal transmission is improved.

In the multi-broad band antenna 100, the short-circuit elements 151~153 connect the first radiating body 110, the second radiating body 120 and the third radiating body 130 to the grounding plate 140 respectively, such that the first radiating body 110, the second radiating body 120 and the third radiating body 130 short-circuit with the grounding plate 140. The short-circuit effect is similar to the effect generated under the structure of the planar inverted F antenna (PIFA), so the short-circuit elements 151~153 are conducive to the miniaturization of the multi-broad band antenna 100. Besides, the disposition of the T-shaped symmetric structures 171~173 also help to downsize the multi-broad band antenna 100. As the first radiating body 110, the second radiating body 120 and the third radiating body 130 are grounded separately, the interconnection between the high frequency wide bandwidth, the middle frequency wide bandwidth and the low frequency wide bandwidth is reduced such that the radio frequency characteristics are optimized.

The three feed-in points of the multi-broad band antenna 100 are substantially connected to three co-axial lines (not illustrated) respectively. The cores of the three co-axial lines are respectively connected to the first radiating body 110, the second radiating body 120 and the third radiating body 130, and the connecting points are the feed-in points. The external conductors of the co-axial lines are connected to the grounding plate 140 for the signal to be grounded. In the multi-broad band antenna 100, the first grounding regulator 161 and the second grounding regulator 162 respectively short-circuit the shielding metal (not illustrated in FIG. 1A and FIG. 1B), such that the cross-section of the electromagnetic filed of the multi-broad band antenna 100 is increased and the quality in the reception/transmission of signal is improved. On the other hand, the first grounding regulator 161 and the second grounding regulator 162 can also be viewed as an extension of the grounding plate 140, and are conducive to the impedance matching of the multi-broad band antenna 100.

Figure 2:
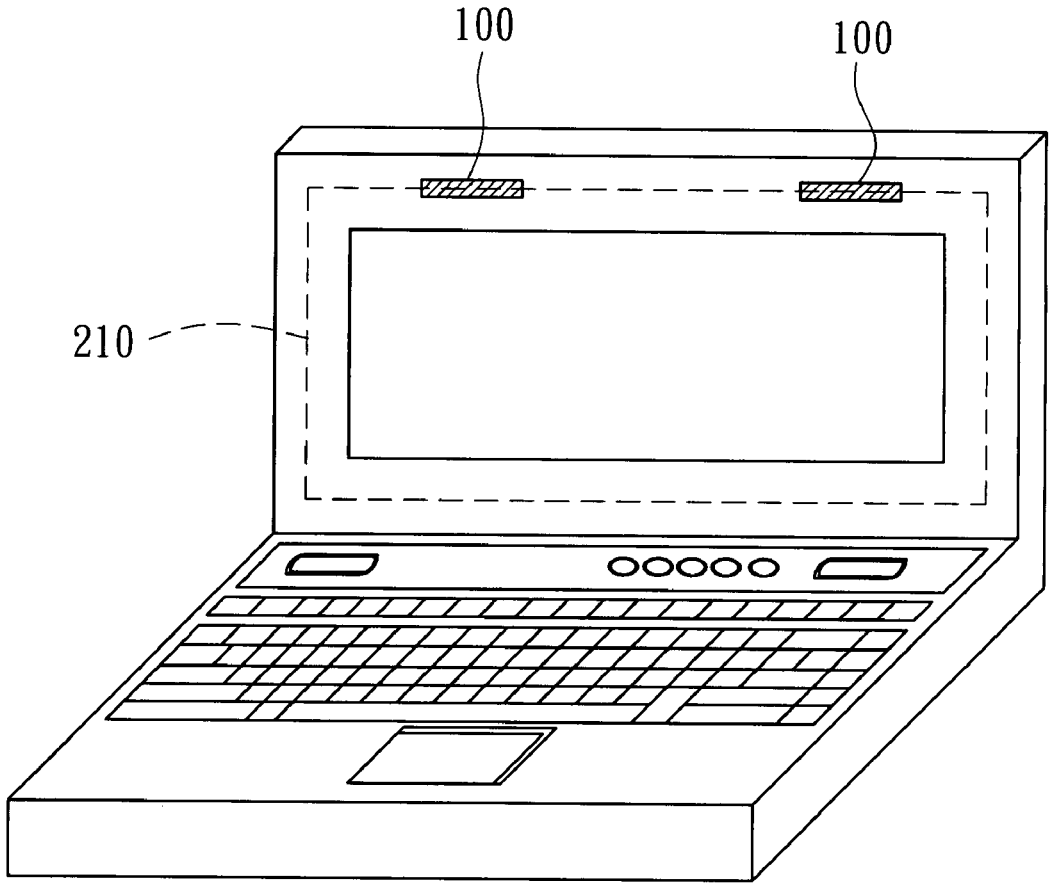
FIG. 2 is a perspective of the multi-broad band antenna 100 according to a preferred embodiment of the invention disposed in a portable electronic device.

Referring to FIG. 2, a perspective of the multi-broad band antenna 100 according to a preferred embodiment of the invention disposed in a portable electronic device is shown. Examples of the portable electronic device 200 include notebook computer or ultra mobile PC. The portable electronic device 200 has a shielding metal 210 disposed therein for reducing electromagnetic interference and enhancing the anti-radiation interference of the system. In practical application, a number of multi-broad band antennas 100 (FIG. 2 is exemplified by two multi-broad band antennas) form an antenna diversity structure and are connected to the shielding metal 210 for increasing the surface area of the antenna, such that the multi-broad band antenna 100 has better effect in the reception and transmission of the signal.

Figure 3A:
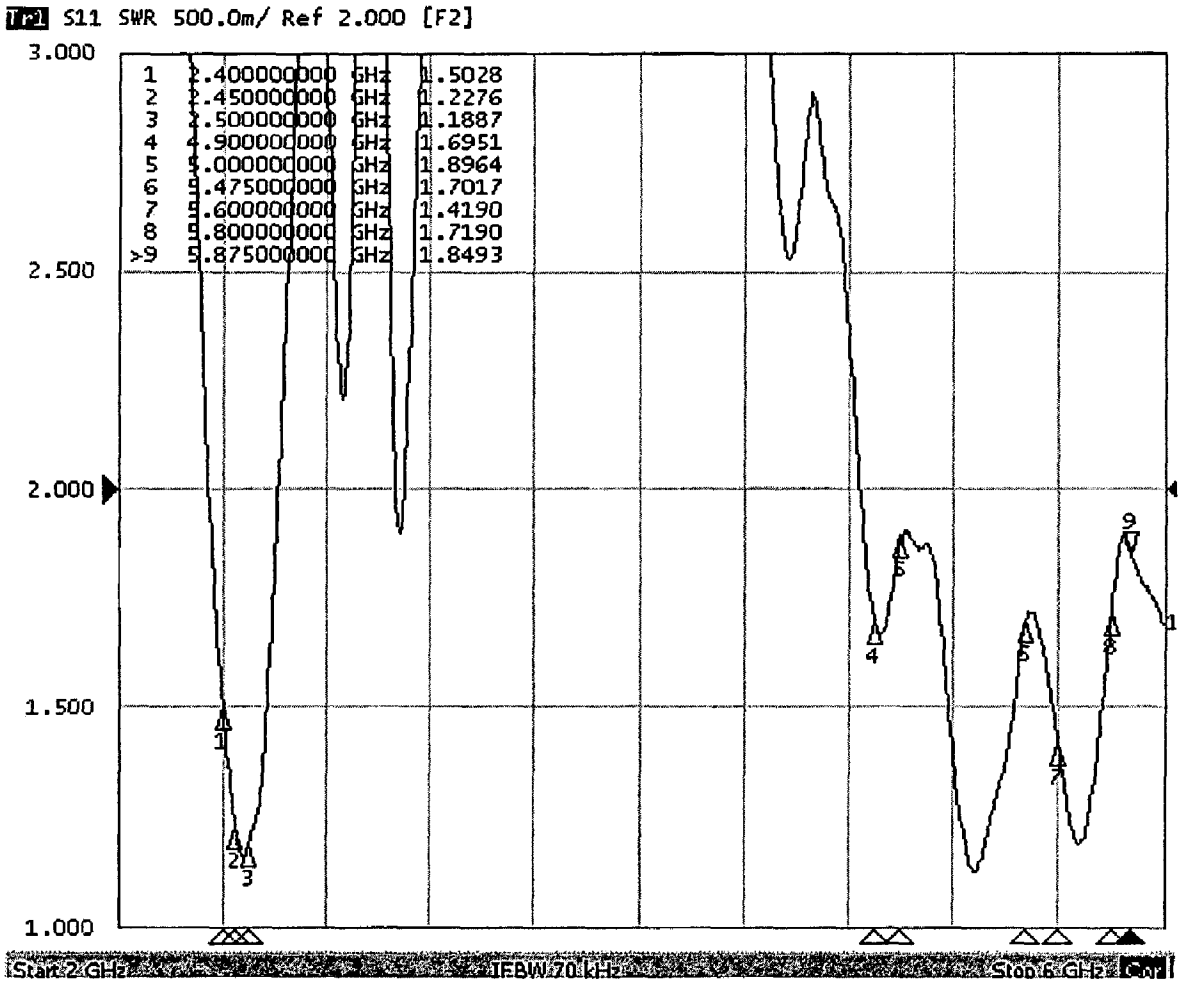
FIG. 3A is a measurement of standing-wave ratio of the multi-broad band antenna 100 according to a preferred embodiment of the invention being at a high frequency wide bandwidth.
Figure 3B:
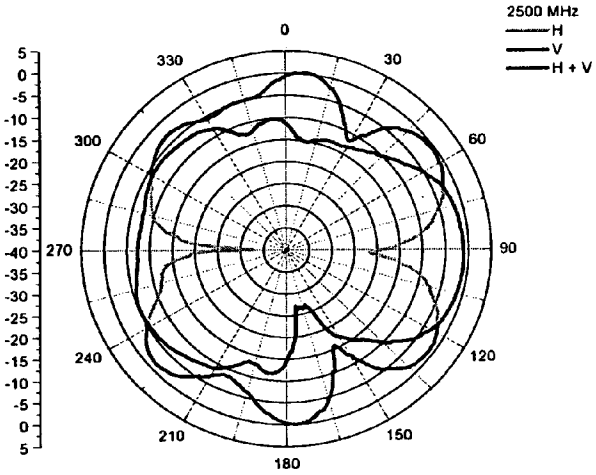
FIG. 3B~E are radiation patterns of the multi-broad band antenna 100 according to a preferred embodiment of the invention being at a high frequency wide bandwidth.
Figure 3B:
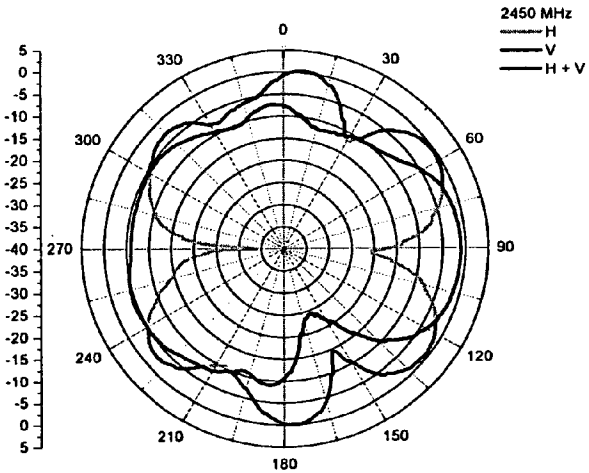
Figure 3B:
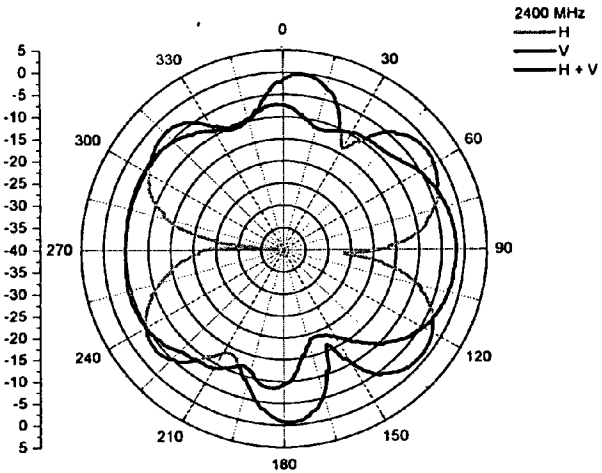
Figure 3C:
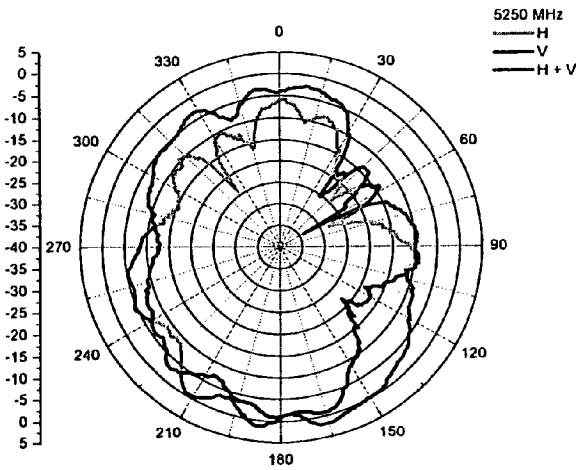
Figure 3C:
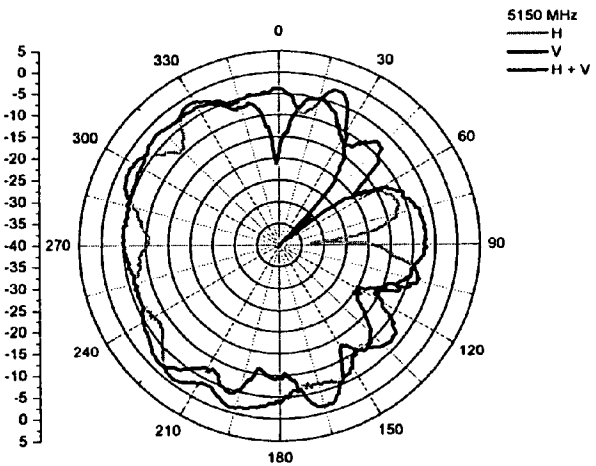
Figure 3C:
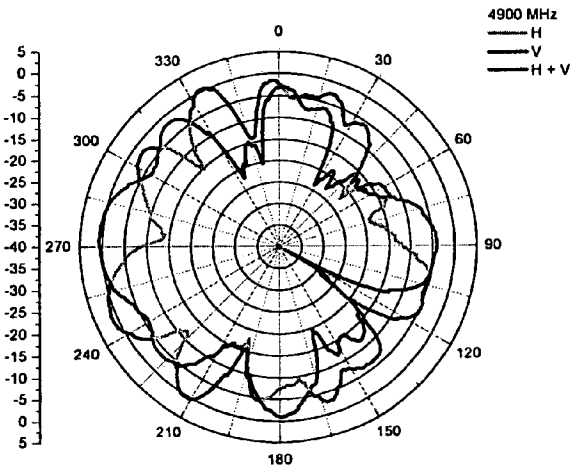
Figure 3D:
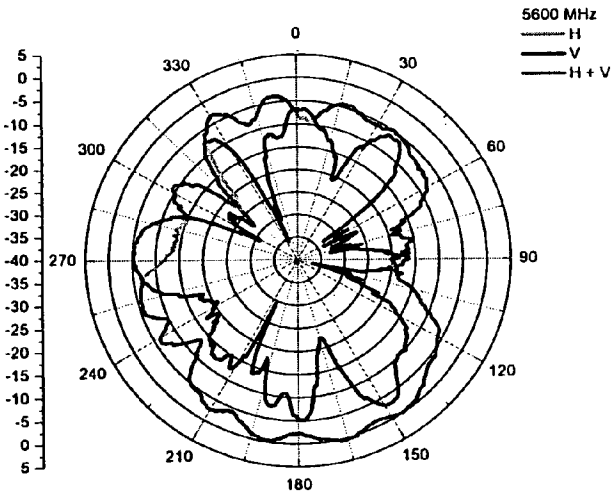
Figure 3D:
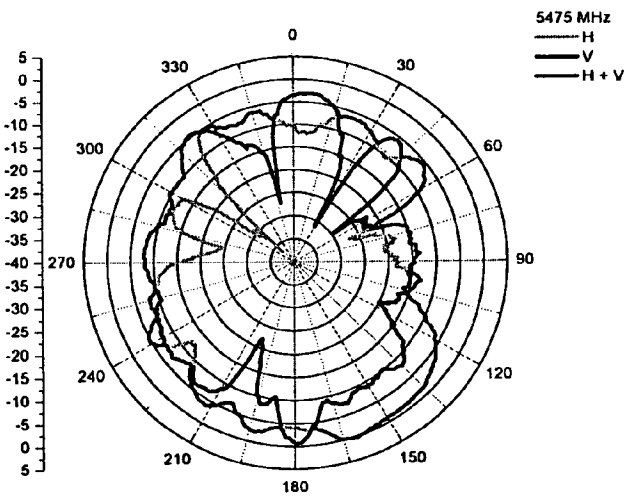
Figure 3D:
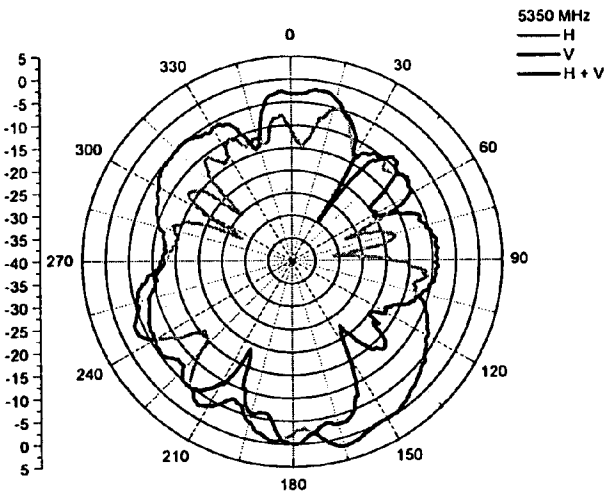
Figure 3E:
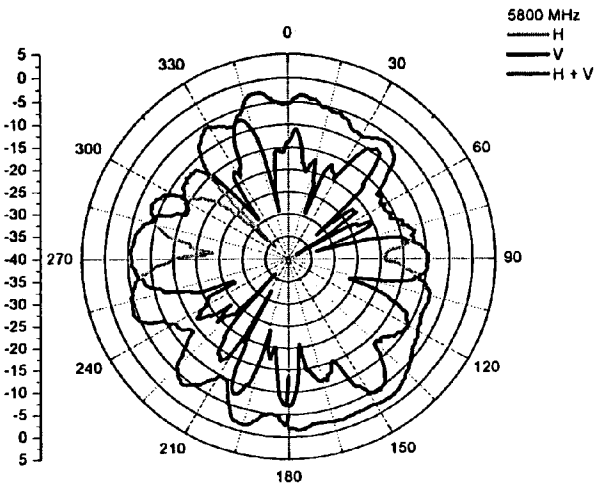
Figure 3E:
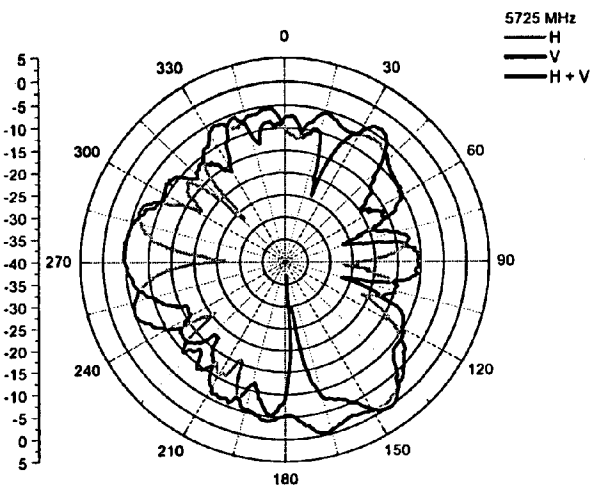
Figure 3E:
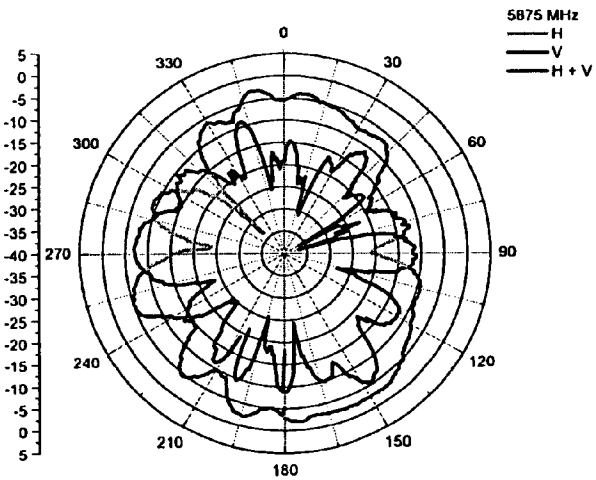

Referring to FIG. 3A, a measurement of standing-wave ratio of the multi-broad band antenna 100 according to a preferred embodiment of the invention being at a high frequency wide bandwidth is shown. As indicated in numeric designations 1~9, the standing-wave ratios of the operating frequencies of 2.4~2.5 GHz and 4.9~5.875 GHz are lower than 2, so the multi-broad band antenna disclosed in the embodiment of the invention has excellent impedance matching characteristics at the high frequency wide bandwidth. Referring to FIG. 3B~E, radiation patterns of the multi-broad band antenna 100 according to a preferred embodiment of the invention being at a high frequency wide bandwidth are shown. As indicated in FIG. 3B~E, when the multi-broad band antenna of the present embodiment of the invention is at a high frequency wide bandwidth, the multi-broad band antenna generates a nearly omni-directional radiation pattern and is adaptable in practical application.

Referring to Table 1, the antenna gain measurement of the multi-broad band antenna of the invention at the high frequency wide bandwidth (2.4~2.5 GHz and 4.9~5.875 GHz) is illustrated. According to the peak gain of each frequency of the high frequency wide bandwidth, the radiation pattern of the multi-broad band antenna approximates a circle within the frequency of 2.4~2.5 GHz, and the radiation pattern of the multi-broad band antenna approximates an ellipse within the frequency of 4.9~5.875 GHz. Furthermore, the average gain of each frequency of the high frequency wide bandwidth also shows that the multi-broad band antenna of the invention has excellent radiation efficiency at the high frequency wide bandwidth.

TABLE 1

| Frequency (GHz) | Peak Gain (Dbi) | Average Gain (Dbi) |
|---|---|---|
| 2.40 | 1.31 | −2.86 |
| 2.45 | 0.67 | −2.93 |
| 2.50 | −0.66 | −2.71 |
| 4.90 | −1.25 | −4.12 |
| 5.15 | 0.77 | −2.82 |
| 5.25 | 1.56 | −2.70 |
| 5.35 | 1.50 | −2.81 |
| 5.475 | 1.81 | −2.84 |
| 5.60 | 2.49 | −2.71 |
| 5.725 | 2.33 | −3.13 |
| 5.80 | 2.64 | −3.44 |
| 5.875 | 2.44 | −3.62 |

Figure 3F:
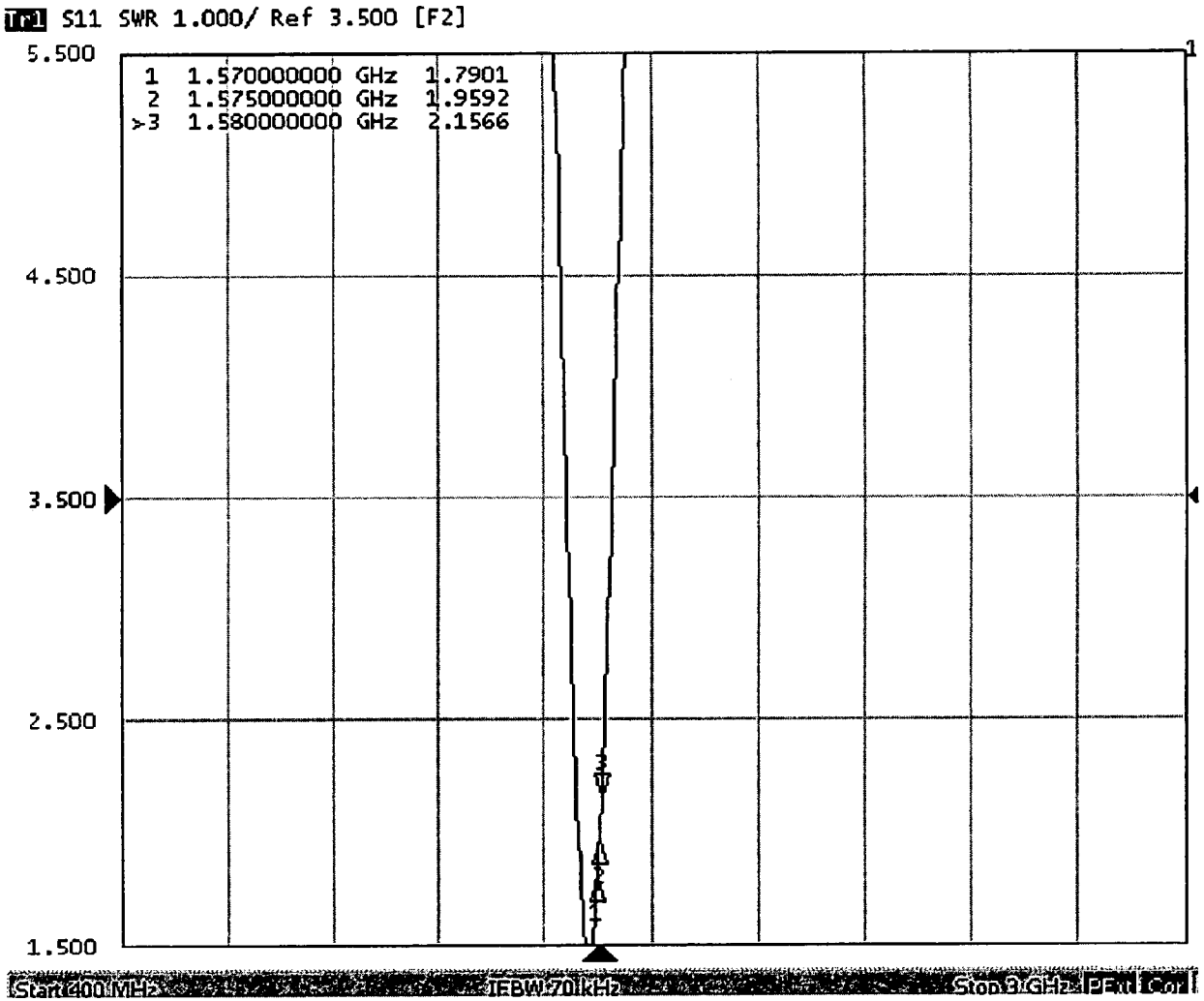
FIG. 3F is a measurement of standing-wave ratio of the multi-broad band antenna 100 according to a preferred embodiment of the invention being at a middle frequency wide bandwidth.
Figure 3G:
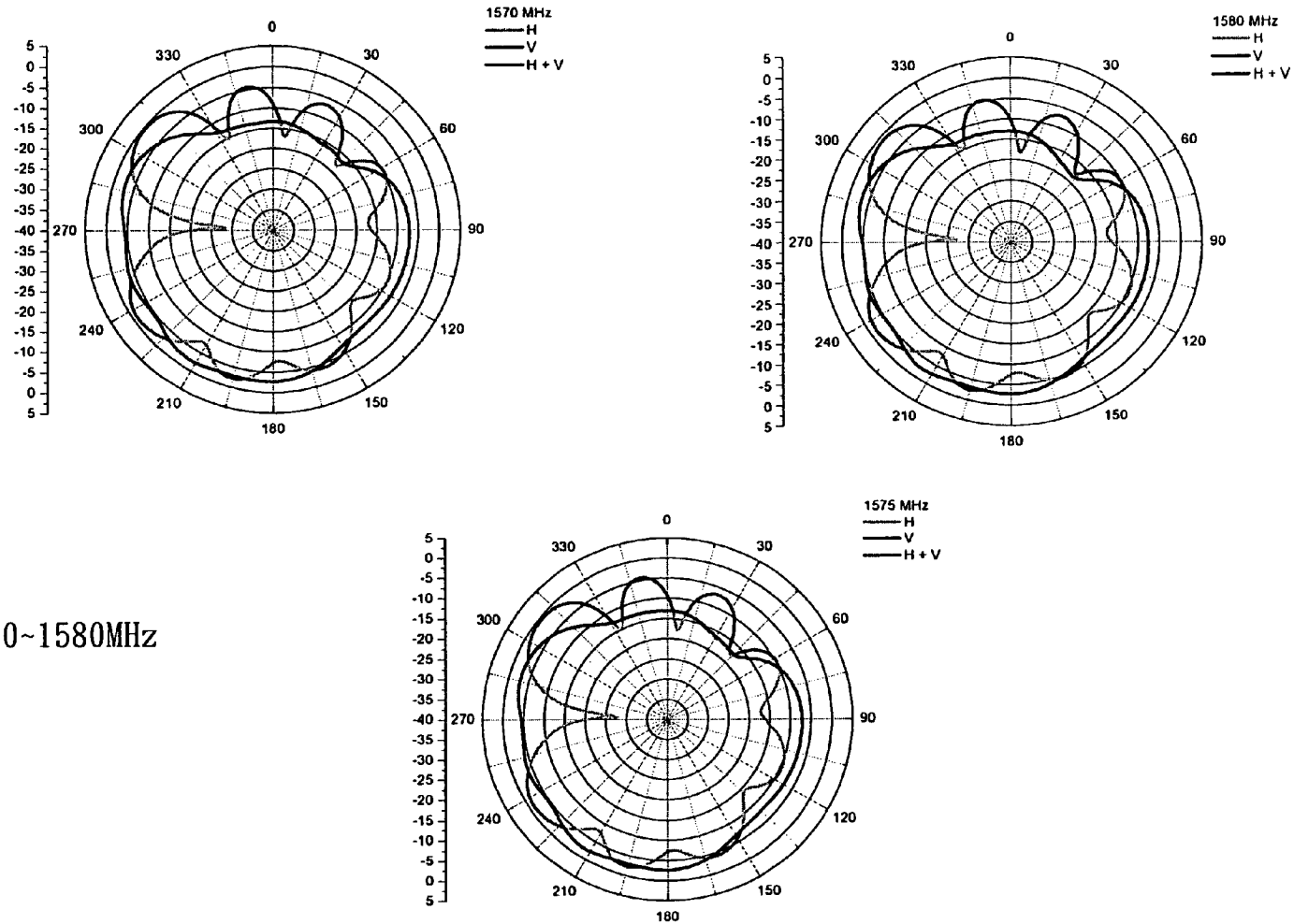
FIG. 3G is the radiation pattern of the multi-broad band antenna 100 according to a preferred embodiment of the invention being at a middle frequency wide bandwidth.

Referring to FIG. 3F, a measurement of standing-wave ratio of the multi-broad band antenna 100 according to a preferred embodiment of the invention being at a middle frequency wide bandwidth is shown. As indicated in numeric designations 1~3, the standing-wave ratios of the operating frequencies of 1.575 GHz are lower than 2.5, so the multi-broad band antenna disclosed in the embodiment of the invention has excellent impedance matching characteristics at the middle frequency wide bandwidth. Referring to FIG. 3G, the radiation pattern of the multi-broad band antenna 100 according to a preferred embodiment of the invention being at a middle frequency wide bandwidth is shown. As indicated in FIG. 3G, when the multi-broad band antenna of the present embodiment of the invention is at the middle frequency wide bandwidth, the multi-broad band antenna generates a nearly omni-directional radiation pattern and is adaptable in practical application.

Referring to Table 2, the antenna gain measurement of the multi-broad band antenna of the invention at middle frequency wide bandwidth (1.575 GHz) is illustrated. According to the peak gain of each frequency of the middle frequency wide bandwidth, the radiation pattern of the multi-broad band antenna approximates a circle at the frequency of 1.575 GHz. Furthermore, the average gain of each frequency of the middle frequency wide bandwidth also shows that the multi-broad band antenna of the invention has excellent radiation efficiency at the middle frequency wide bandwidth.

TABLE 2

| Frequency (GHz) | Peak Gain (Dbi) | Average Gain (Dbi) |
|---|---|---|
| 1.57 | −0.32 | −2.90 |
| 1.575 | −0.50 | −2.98 |
| 1.58 | −0.95 | −3.31 |

Figure 3H:
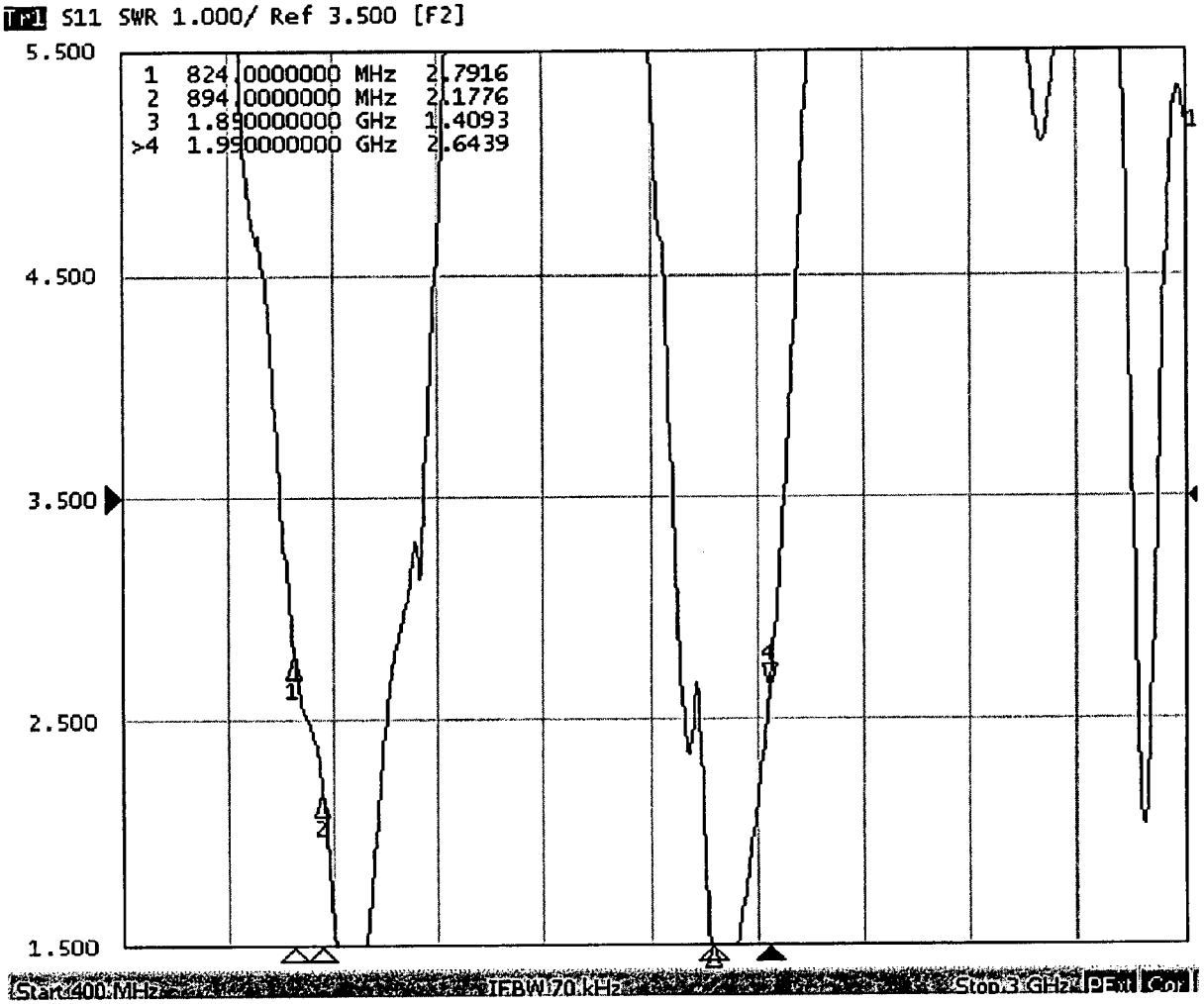
FIG. 3H is a measurement of standing-wave ratio of the multi-broad band antenna 100 according to a preferred embodiment of the invention being at a low frequency wide bandwidth.
Figure 3I:
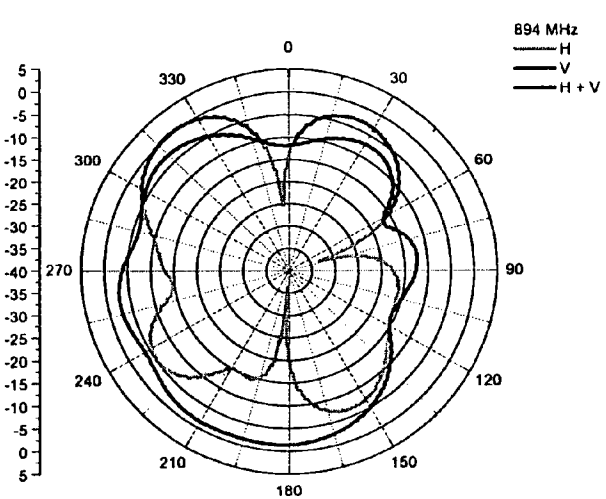
FIG. 3I~3J are radiation patterns of the multi-broad band antenna 100 according to a preferred embodiment of the invention being at a low frequency wide bandwidth.
Figure 3I:
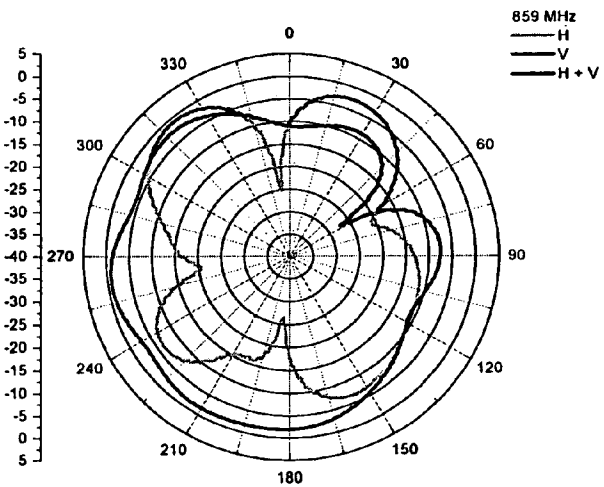
Figure 3I:
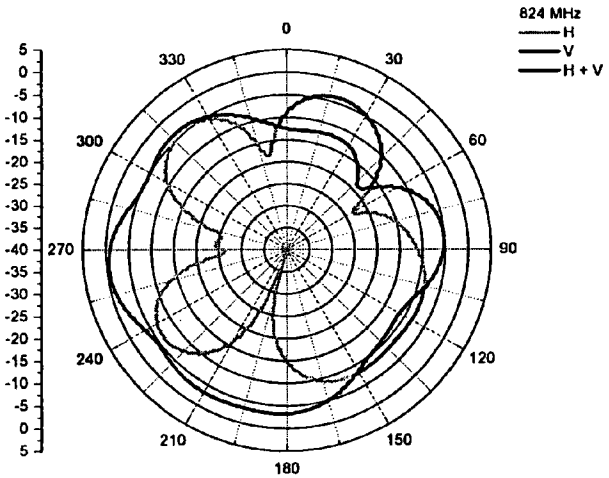
Figure 3J:
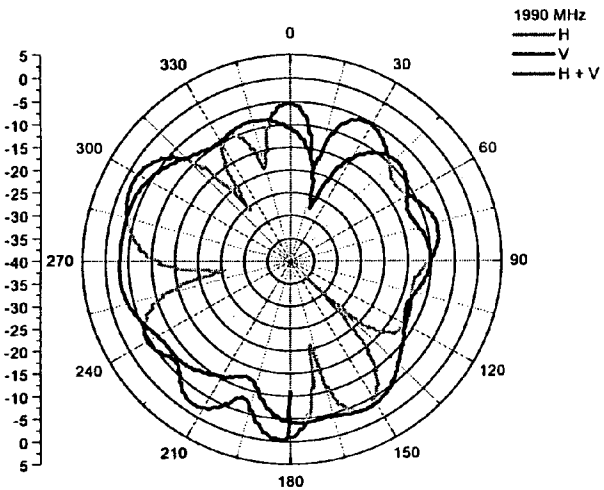
Figure 3J:
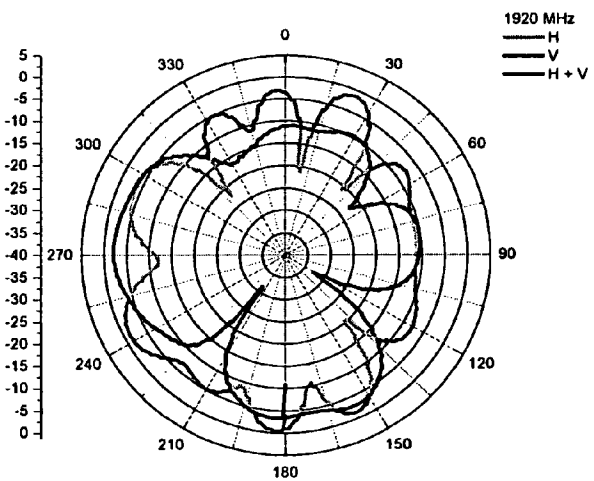
Figure 3J:
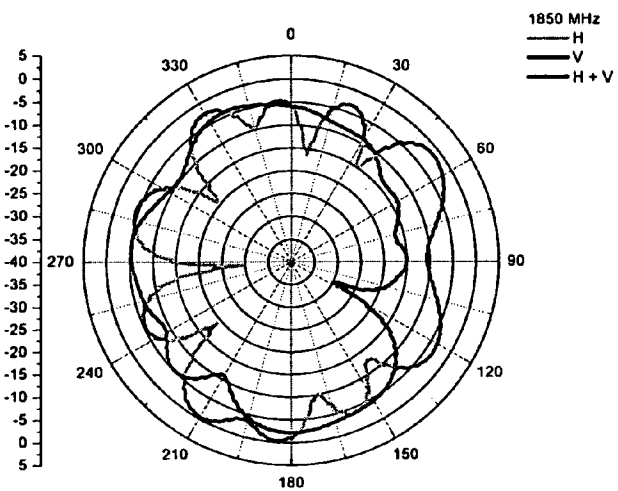

Referring to FIG. 3H, a measurement of standing-wave ratio of the multi-broad band antenna 100 according to a preferred embodiment of the invention being at a low frequency wide bandwidth is shown. As indicated in numeric designations 1~4, the standing-wave ratios of the operating frequencies of 824~894 MHz and 1850~1990 MHz are lower than 2.8, so the multi-broad band antenna disclosed in the embodiment of the invention has excellent impedance matching characteristics at the low frequency wide bandwidth. Referring to FIG. 3I~3J, radiation patterns of the multi-broad band antenna 100 according to a preferred embodiment of the invention being at a low frequency wide bandwidth are shown. As indicated in FIG. 3I~3J, when the multi-broad band antenna of the present embodiment of the invention is at the low frequency wide bandwidth, the multi-broad band antenna generates a nearly omni-directional radiation pattern and is adaptable in practical application.

Referring to Table 3, the antenna gain measurement of the multi-broad band antenna of the invention at the low frequency wide bandwidth (824~894 MHz and 1850~1990 MHz) is illustrated. According to the peak gain of each frequency of the low frequency wide bandwidth, the radiation pattern of the multi-broad band antenna approximates a circle within the frequency of 824~894 MHz and 1850~1990 MHz. Furthermore, the average gain of each frequency of the low frequency wide bandwidth also shows that the multi-broad band antenna of the invention has excellent radiation efficiency at the low frequency wide bandwidth.

TABLE 3

| Frequency (GHz) | Peak Gain (Dbi) | Average Gain (Dbi) |
|---|---|---|
| 0.824 | −0.96 | −4.32 |
| 0.859 | −1.27 | −3.24 |
| 0.894 | −0.18 | −3.39 |
| 1.85 | −0.44 | −2.95 |
| 1.92 | −0.44 | −3.40 |
| 1.99 | −0.43 | −3.82 |

According to the multi-broad band antenna and the portable electronic device thereof disclosed in the above embodiments of the invention, a multi-broad band antenna incorporates many systems such as GPS, GSM and WLAN in an integrally formed conductive structure. By minimizing the interference of the radiation patterns of many systems, the multi-broad band antenna is able to receive the signals of many systems, the manufacturing cost is reduced, and the reliability of the radio frequency system is increased.

The multi-broad band antenna mainly uses air as a medium without introducing any other mediums such as ceramics, not only increasing the efficiency in the reception and transmission of signal but also downsizing the resonant structure and effectively reducing the volume of the antenna. For example, the multi-broad band antenna 100 disclosed in the embodiment of the invention, having a volume of 100×5×4 mm, is capable of generating three different resonant modes for receiving the signals from many systems. The short-circuit elements connect the radiating bodies to the grounding plate, such that the volume of the antenna is effectively reduced.

Besides, the multi-broad band antenna 100 disclosed in the embodiments of the invention enhances the impedance matching and expands the bandwidth. The first grounding regulator 161 and the second grounding regulator 162 enhance the impedance matching of high frequency mode and expand a part of bandwidth at the same time. The electrical connection between the multi-broad band antenna 100 and the shielding metal 210 not only improves the efficiency of electromagnetic radiation but also has the feature of electromagnetic compatibility, such that the overall high frequency performance of the system is increased. The multi-broad band antenna disclosed in the embodiment of the invention being simple in structure and having the features of minimized volume, excellent high frequency characteristics and high reliability, is adaptable to the concealed antenna systems of various portable electronic devices such as ultra mobile PC.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A multi-broad band antenna, comprising:

a first radiating body exciting a first resonant mode, such that the multi-broad band antenna has a high frequency bandwidth;

a second radiating body exciting a second resonant mode, such that the multi-broad band antenna has a middle frequency bandwidth;

a third radiating body exciting a third resonant mode, such that the multi-broad band antenna has a low frequency bandwidth;

a plurality of T-shaped symmetric structures selectively disposed on the first radiating body, the second radiating body, and the third radiating body to expand the bandwidths of the high frequency bandwidth, the middle frequency bandwidth and the low frequency bandwidth;

a grounding plate; and a plurality of short-circuit elements connecting the first radiating body, the second radiating body, and the third radiating body to the grounding plate respectively;

wherein radiation patterns of the first resonant mode, the second resonant mode, and the third resonant mode do not disturb each other.

2. The multi-broad band antenna according to claim 1, wherein the radiation patterns of the first resonant mode, the second resonant modes, and the third resonant mode diverge in different directions.

3. The multi-broad band antenna according to claim 1, wherein the high frequency bandwidth is in a 2.4~2.5 GHz band and in a 4.9~5.875 GHz band.

4. The multi-broad band antenna according to claim 3, wherein the first radiating body has the T-shaped symmetric structure disposed thereon.

5. The multi-broad band antenna according to claim 1, wherein the middle frequency bandwidth is in a 1.575 GHz band.

6. The multi-broad band antenna according to claim 1, wherein the low frequency bandwidth is in a 824~894 MHz band and in a 1850~1990 MHz band.

7. The multi-broad band antenna according to claim 6, wherein the third radiating body has a first sub-radiating body and a second sub-radiating body, and the first sub-radiating body and the second sub-radiating body respectively have the T-shaped symmetric structure disposed thereon.

8. The multi-broad band antenna according to claim 1, wherein the first radiating body, the second radiating body, the third radiating body, the grounding plate, and the short-circuit elements are integrally formed in one piece.

9. The multi-broad band antenna according to claim 1, further comprising a first grounding regulator and a second grounding regulator enhancing the impedance matching of the multi-broad band antenna at the high frequency bandwidth, the middle frequency bandwidth, and the low frequency bandwidth.

10. The multi-broad band antenna according to claim 9, wherein the first radiating body, the second radiating body, the third radiating body, the grounding plate, the short-circuit elements, the first grounding regulator, and the second grounding regulator are integrally formed in one piece.

11. The multi-broad band antenna according to claim 1, wherein the grounding plate is electrically connected to a shielding metal for improving the antenna electromagnetic radiation efficiency.

12. A portable electronic device, comprising:

a shielding metal reducing the electromagnetic interference; and a multi-broad band antenna, comprising:

a first radiating body exciting a first resonant mode, such that the multi-broad band antenna has a high frequency bandwidth;

a second radiating body exciting a second resonant mode, such that the multi-broad band antenna has a middle frequency bandwidth;

a third radiating body exciting a third resonant mode, such that the multi-broad band antenna has a low frequency bandwidth;

a plurality of T-shaped symmetric structures selectively disposed on the first radiating body, the second radiating body, and the third radiating body to expand the bandwidths of the high frequency bandwidth, the middle frequency bandwidth and the low frequency bandwidth;

a grounding plate; and a plurality of short-circuit elements connecting the first radiating body, the second radiating body, and the third radiating body to the grounding plate respectively;

wherein radiation patterns of the first resonant mode, the second resonant mode, and the third resonant mode do not disturb each other.

13. The portable electronic device according to claim 12, wherein the radiation patterns of the first resonant mode, the second resonant mode, and the third resonant mode diverge in different directions.

14. The portable electronic device according to claim 12, wherein the high frequency bandwidth is in a 2.4~2.5 GHz band and in a 4.9~5.875 GHz band.

15. The portable electronic device according to claim 14, wherein the first radiating body has the T-shaped symmetric structure disposed thereon.

16. The portable electronic device according to claim 12, wherein the middle frequency bandwidth is in a 1.575 GHz band.

17. The portable electronic device according to claim 12, wherein the low frequency bandwidth is in a 824~894 MHz band and in a 1850~1990 MHz band.

18. The portable electronic device according to claim 17, wherein the third radiating body has a first sub-radiating body and a second sub-radiating body, and the first sub-radiating body and the second sub-radiating body respectively have the T-shaped symmetric structure disposed thereon.

19. The portable electronic device according to claim 12, wherein the first radiating body, the second radiating body, the third radiating body, the grounding plate, and the short-circuit elements are integrally formed in one piece.

20. The portable electronic device according to claim 12, the multi-broad band antenna further comprises a first grounding regulator and a second grounding regulator enhancing the impedance matching of the multi-broad band antenna at the high frequency bandwidth, the middle frequency bandwidth, and the low frequency bandwidth.

21. The portable electronic device according to claim 20, wherein the first radiating body, the second radiating body, the third radiating body, the grounding plate, the short-circuit elements, the first grounding regulator and the second grounding regulator are integrally formed in one piece.

22. The portable electronic device according to claim 12, the portable electronic device is a notebook computer.

23. The portable electronic device according to claim 12, the portable electronic device is an ultra mobile PC (UMPC).

24. A multi-broad band antenna, comprising:

a first radiating body exciting a first resonant mode, such that the multi-broad band antenna has a high frequency bandwidth;

a second radiating body exciting a second resonant mode, such that the multi-broad band antenna has a middle frequency bandwidth;

a third radiating body exciting a third resonant mode, such that the multi-broad band antenna has a low frequency bandwidth;

a grounding plate; and a plurality of short-circuit elements connecting the first radiating body, the second radiating body, and the third radiating body to the grounding plate respectively;

wherein radiation patterns of the first resonant mode, the second resonant mode, and the third resonant mode do not disturb each other;

wherein the radiation pattern of the first resonant mode mainly diverges in a first direction, the radiation pattern of the second resonant mode mainly diverges in a second direction opposite to the first direction, and the radiation pattern of the third resonant mode mainly diverges in a third direction orthogonal to the first direction and the second direction.

25. A portable electronic device, comprising:

a shielding metal reducing the electromagnetic interference; and a multi-broad band antenna, comprising:

a first radiating body exciting a first resonant mode, such that the multi-broad band antenna has a high frequency bandwidth;

a second radiating body exciting a second resonant mode, such that the multi-broad band antenna has a middle frequency bandwidth;

a third radiating body exciting a third resonant mode, such that the multi-broad band antenna has a low frequency bandwidth;

a grounding plate; and a plurality of short-circuit elements connecting the first radiating body, the second radiating body, and the third radiating body to the grounding plate respectively;

wherein radiation patterns of the first resonant mode, the second resonant mode, and the third resonant mode do not disturb each other;

wherein the radiation pattern of the first resonant mode mainly diverges in a first direction, the radiation pattern of the second resonant mode mainly diverges in a second direction opposite to the first direction, and the radiation pattern of the third resonant mode mainly diverges in a third direction orthogonal to the first direction and the second direction.

* * * * *